US006953390B2

(12) United States Patent
Sakurai et al.

(10) Patent No.: US 6,953,390 B2
(45) Date of Patent: Oct. 11, 2005

(54) POLISHING APPARATUS

(75) Inventors: Kunihiko Sakurai, Tokyo (JP); Hiroshi Yoshida, Tokyo (JP); Tetsuji Togawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/342,253

(22) Filed: Jan. 15, 2003

(65) Prior Publication Data

US 2003/0134580 A1 Jul. 17, 2003

(30) Foreign Application Priority Data

Jan. 15, 2002 (JP) ..... 2002-006718

(51) Int. Cl.[7] ..... B24B 1/00

(52) U.S. Cl. ..... 451/56; 451/57; 451/444; 451/443

(58) Field of Search ..... 451/56, 72, 443, 451/444, 57

(56) References Cited

U.S. PATENT DOCUMENTS

| | | | | |
|---|---|---|---|---|
| 4,680,893 A | | 7/1987 | Cronkhite et al. | |
| 5,154,021 A | | 10/1992 | Bombardier et al. | |
| 5,578,529 A | | 11/1996 | Mullins | |
| 5,702,563 A | | 12/1997 | Salugsugan et al. | |
| 5,902,173 A | * | 5/1999 | Tanaka | 451/56 |
| 5,961,377 A | * | 10/1999 | Jeong | 451/56 |
| 6,126,530 A | * | 10/2000 | Hirata | 451/444 |
| 6,135,868 A | * | 10/2000 | Brown et al. | 451/443 |
| 6,350,183 B2 | * | 2/2002 | Manfredi | 451/56 |
| 6,645,053 B1 | * | 11/2003 | Kimura et al. | 451/56 |

FOREIGN PATENT DOCUMENTS

| | | |
|---|---|---|
| JP | 03-228569 | 10/1991 |
| JP | 09-131659 | 5/1997 |
| JP | 10-202504 | 8/1998 |
| JP | 2002-144227 | 5/2002 |

* cited by examiner

*Primary Examiner*—Dung Van Nguyen
(74) *Attorney, Agent, or Firm*—Wenderoth, Lind & Ponack, L.L.P.

(57) ABSTRACT

A polishing surface is conditioned by pressing a diamond dresser against the polishing surface to thinly shave a surface of the polishing surface. Foreign matter clogging concavities formed in the polishing surface is scraped by pressing a brush dresser against the polishing surface in a state such that a polishing liquid is not supplied to the polishing table. A liquid composed of a mixture of a liquid or inert gas with pure water or a chemical liquid is ejected onto the polishing surface to clean the polishing surface.

8 Claims, 12 Drawing Sheets

POLISHING APPARATUS

BACKGROUND OF THE INVENTION

1. Field of the Invention

The present invention relates to a polishing apparatus for polishing a workpiece, and more particularly to a polishing apparatus for polishing a workpiece having a thin film formed thereon, such as a semiconductor wafer, to a flat mirror finish. The present invention also relates to a method of dressing a polishing surface, and more particularly to a method of dressing a polishing surface serving to polish a workpiece such as a semiconductor wafer by sliding contact.

2. Description of the Related Art

As semiconductor devices have become more highly integrated in recent years, circuit interconnections have become finer and distances between those circuit interconnections have become smaller. In a case of photolithography, which can form interconnections that are at most 0.5 $\mu$m wide, it is required that surfaces on which pattern images are to be focused by a stepper should be as flat as possible because a depth of focus of an optical system is relatively small. A polishing apparatus for performing chemical mechanical polishing (CMP) has been used for planarizing such a semiconductor wafer.

In a polishing apparatus for polishing and planarizing a surface of a semiconductor wafer on which a device pattern is formed, a non-woven fabric has heretofore been used as a polishing cloth attached to an upper surface of a polishing table. However, as ICs (integrated circuits) and LSIs (large scale integrated circuits) have become more highly integrated in recent years, it is required to reduce the difference in the level of a surface, to be polished, of the device pattern by polishing. In order to meet such demand for reducing a difference in level of a surface, to be polished, of the device pattern, a polishing cloth made of a hard material, e.g., a polishing cloth of foamed polyurethane, has been used in a polishing apparatus.

This type of polishing apparatus comprises, as shown in FIG. 1, a polishing table 502 having a polishing pad (polishing cloth) 500 attached thereon, and a top ring 504 for holding a workpiece W to be polished, such as a semiconductor wafer, in a manner such that a surface to be polished faces the polishing table 502. The polishing pad 500 has an upper surface serving as a polishing surface. In this polishing apparatus, a semiconductor wafer W is polished as follows. Polishing table 502 and top ring 504 are independently rotated, and, while a polishing liquid is supplied from a polishing liquid supply nozzle 506 provided above polishing table 502, the semiconductor wafer W is pressed against polishing pad 500 on polishing table 502 at a predetermined pressure by top ring 504. For example, a suspension of fine polishing particles of silica or the like in an alkali solution is used as a polishing liquid supplied from polishing liquid supply nozzle 506. Thus, the semiconductor wafer W is polished to a flat mirror finish by the combined effect of a chemical polishing effect attained by the alkali and a mechanical polishing effect attained by the polishing particles.

When a semiconductor wafer W is continuously polished in a state such that the semiconductor wafer W is brought into contact with polishing pad 500 which is rotated together with polishing table 502, polishing particles or polishing wastes are attached to polishing pad 500, resulting in a change in properties of polishing pad 500 and a deterioration in polishing performance. Therefore, if polishing pad 500 is repeatedly used for polishing semiconductor wafers W, problems such as lowered polishing rate and uneven polishing are caused. In order to overcome such problems, conditioning called dressing is performed before, after or during polishing of a semiconductor wafer to regenerate the polishing pad.

In order to perform a dressing process of a polishing pad, a dresser 508 is provided in a polishing apparatus, as shown in FIG. 1. Polishing pad 500 may be dressed by dresser 508 at the time, for example, of replacement of a semiconductor wafer W to be polished. Specifically, while a dressing element attached to a lower surface of dresser 508 is pressed against polishing pad 500 on polishing table 502, polishing table 502 and dresser 508 are independently rotated to remove polishing particles and polishing wastes attached to the polishing surface and to flatten and dress the entire polishing surface. Thus, the polishing surface is regenerated by a dressing process.

In order to enhance a capability of holding a polishing liquid on a surface of polishing pad 500, concavities such as grooves or fine holes may be formed in the surface of polishing pad 500. When a polishing process is repeatedly performed, these concavities in polishing pad 500 may be clogged with polishing particles or polishing wastes. Further, in a dressing process, the concavities in polishing pad 500 may be clogged with dressing wastes produced by dressing polishing pad 500. If the concavities formed in polishing pad 500 are clogged with such foreign matter, then a capability of holding a polishing liquid on a surface of polishing pad 500 is lowered to thereby deteriorate polishing performance. Specifically, after an identical polishing pad is repeatedly used to polish a number of semiconductor wafers, a polishing rate is relatively lowered at a central portion of a surface of a semiconductor wafer due to the foreign matter clogging the concavities. Therefore, a semiconductor wafer cannot be polished as expected.

SUMMARY OF THE INVENTION

The present invention has been made in view of the above drawbacks. It is, therefore, an object of the present invention to provide a polishing apparatus and a dressing method which can effectively remove foreign matter clogging concavities formed in a polishing surface to regenerate the polishing surface so as to have a high polishing performance and to achieve high-quality polishing.

According to a first aspect of the present invention, there is provided a dressing method for dressing a polishing surface of a polishing table. A polishing surface is conditioned by pressing a first dresser against the polishing surface to shave off a portion of the polishing surface. Foreign matter clogging concavities formed in the polishing surface is scraped by pressing a second dresser against the polishing surface when a polishing liquid is not supplied to the polishing table. In this case, the second dresser should preferably comprise a brush dresser having a brush.

The first dresser comprises a dresser, for example, a diamond dresser, capable of shaving a surface of a polishing surface. The present invention is suitable for use of a polishing pad or a fixed abrasive having concavities such as grooves or fine holes formed in a surface (polishing surface) thereon, as shown in FIG. 2. As described above, when a polishing process and a dressing process are repeatedly performed, concavities formed in the polishing surface, such as grooves or fine holes, for enhancing a capability of holding a polishing liquid on a polishing surface, are clogged with foreign matter such as polishing wastes and polishing liquid used in the polishing process, or dressing wastes produced by the dressing process. According to the present invention, foreign matter can be scraped from the concavities in the polishing surface with the second dresser (brush dresser). Therefore, the polishing surface can be regenerated so as to have a high polishing performance, and high-quality polishing can be achieved for subsequent workpieces. Further, it is possible to recover a polishing rate at a central portion of the surface of the workpiece, which has been lowered by repetition of a polishing process and a dressing process, to a level equal to that of a new polishing surface.

In this case, the second dresser (brush dresser) may not perform dressing when a polishing liquid is supplied to the polishing surface for the following reasons. A polishing liquid supplied onto the polishing surface for polishing a workpiece is removed from the polishing surface by use of the second dresser to thereby lower efficiency of polishing. When the second dresser is used while supplying a polishing liquid, a large amount of polishing liquid is attached to a brush of the second dresser, and it becomes difficult to remove the attached polishing liquid by cleaning.

According to a preferred aspect of the present invention, a liquid composed of a mixture of a liquid or inert gas with pure water or a chemical liquid is ejected onto the polishing surface to clean the polishing surface. When such a mixed liquid is ejected onto the polishing surface, polishing liquid or polishing wastes can effectively be removed from the polishing surface. In this case, gas in the liquid or the mixed liquid serves not only to remove a polishing liquid and polishing wastes from the polishing surface, but also to scrape a polishing liquid and polishing wastes clogging concavities formed in the polishing surface. Therefore, the atomization during dressing by the second dresser is effective in addition to the aforementioned effect due to the second dresser (brush dresser).

According to another preferred aspect of the present invention, the second dresser is moved from a central portion of the polishing surface toward a peripheral portion of the polishing surface, while the second dresser is pressed against the polishing surface, thereby discharging the foreign matter to an exterior of the polishing surface.

According to another preferred aspect of the present invention, the second dresser is moved from a first peripheral portion of the polishing surface toward a central portion of the polishing surface and then moved toward a second peripheral portion of the polishing surface, while the second dresser is pressed against the polishing surface, thereby discharging the foreign matter to an exterior of the polishing surface.

According to a second aspect of the present invention, a polishing apparatus comprises a polishing table having a polishing surface thereon and a top ring for holding a workpiece and pressing the workpiece against the polishing surface on the polishing table to polish the workpiece. The polishing apparatus further comprises a first dresser for conditioning the polishing surface by pressing a dressing element against the polishing surface to shave off a portion of the polishing surface, and a second dresser for scraping foreign matter clogging concavities formed in the polishing surface by pressing a dressing element against the polishing surface when a polishing liquid is not supplied to the polishing table. In this case, the second dresser should preferably comprise a brush dresser having a brush.

According to a preferred aspect of the present invention, the polishing apparatus further comprises an atomizer operable to eject a liquid composed of a mixture of a liquid or inert gas with pure water or a chemical liquid onto the polishing surface to clean the polishing surface.

According to another preferred aspect of the present invention, the second dresser is mounted on the atomizer, and the atomizer cleans the second dresser. With this arrangement, a cleaning liquid such as pure water may be ejected from the atomizer to wash away a polishing liquid attached to the second dresser (brush dresser) after a dressing process. Thus, the atomizer can also serve as a dresser cleaning device.

According to another preferred aspect of the present invention, the brush dresser has a brush having a shape corresponding to a shape of the concavities formed in the polishing surface. With a brush having a shape corresponding to a shape of the concavities formed in the polishing surface, foreign matter can more effectively be scraped from the concavities in the polishing surface. For example, bristles having a diameter smaller than widths of grooves (concavities) may be implanted in a brush dresser. Alternatively, elasticity of bristles in a brush dresser may be set so as to correspond to depth of grooves (concavities). The diameter of bristles and the elasticity of bristles can be changed by selecting materials for bristles.

According to another preferred aspect of the present invention, the polishing apparatus further comprises a dresser cleaning chamber operable to clean at least one of the first dresser and the second dresser.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
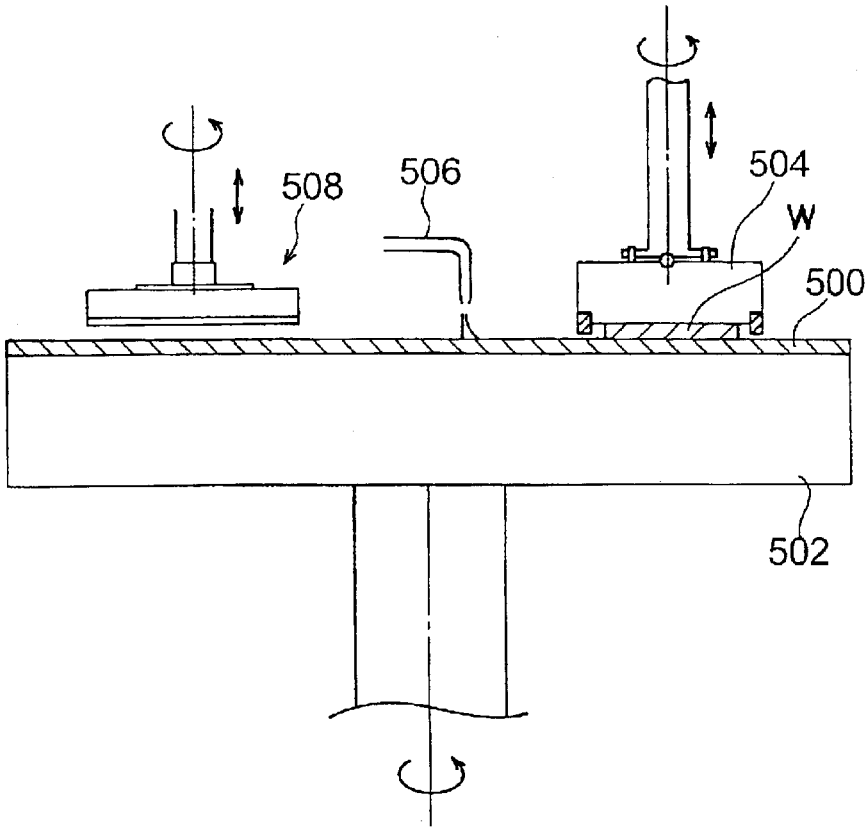
FIG. 1 is a schematic cross-sectional view showing a conventional polishing apparatus.
Figure 2:
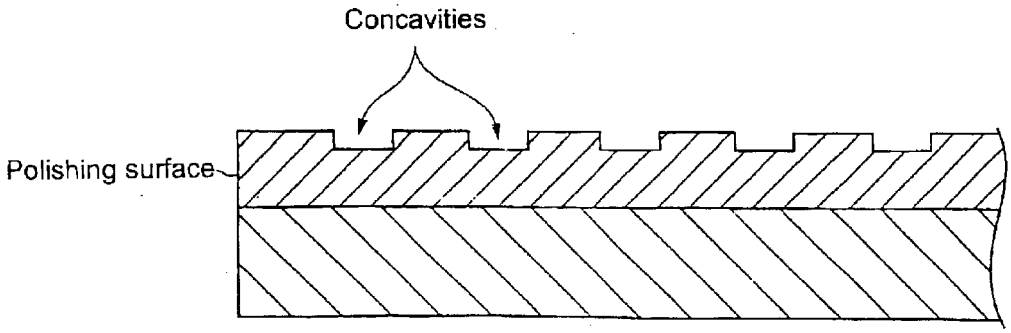
FIG. 2 is a cross-sectional view showing a polishing surface having concavities formed therein.
Figure 3:
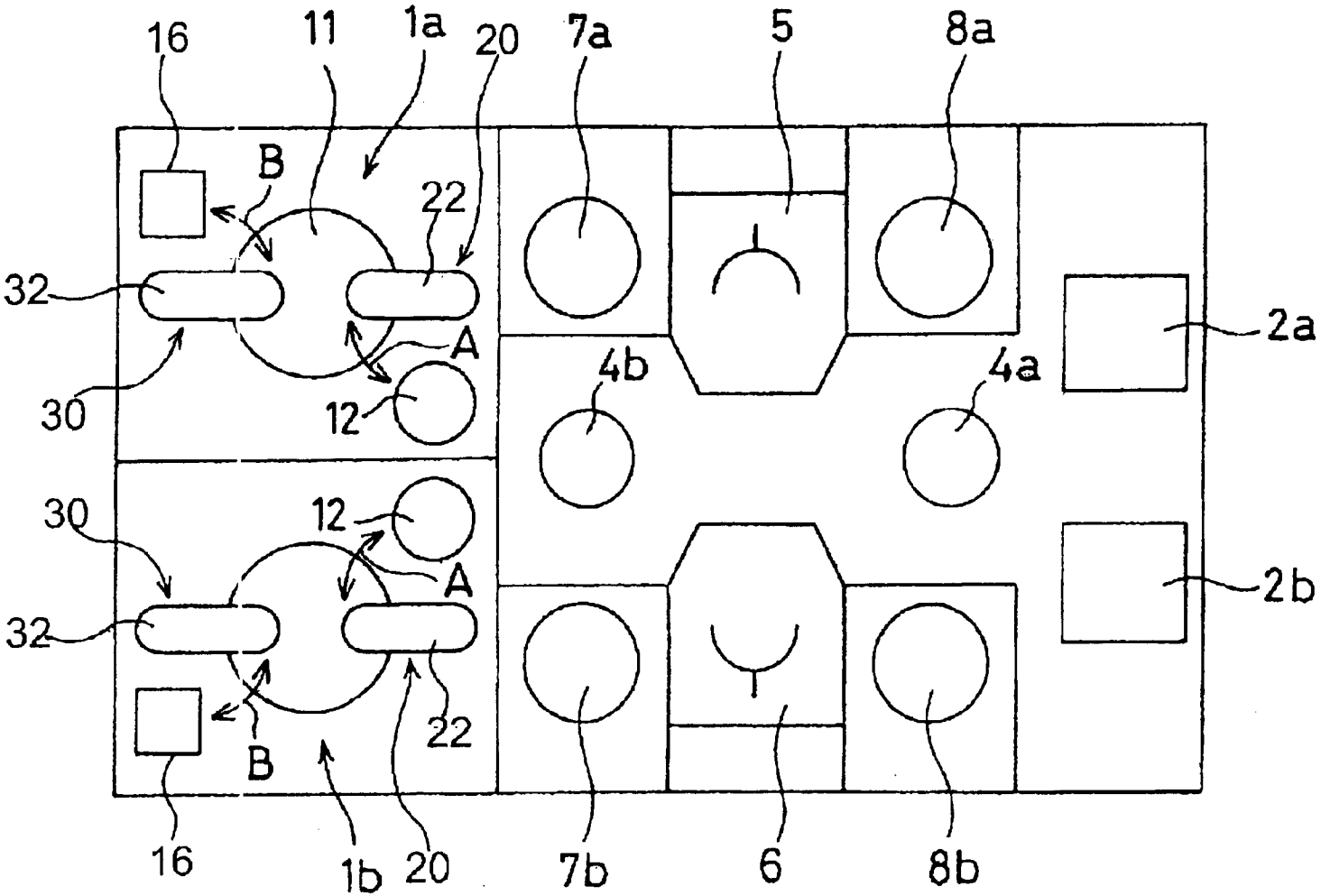
FIG. 3 is a schematic plan view showing a polishing apparatus according to a first embodiment of the present invention.

A polishing apparatus according to a first embodiment of the present invention will be described below with reference to FIGS. 3 through 12. FIG. 3 is a schematic plan view showing a polishing apparatus according to the first embodiment of the present invention.

As shown in FIG. 3, the polishing apparatus has a housing, for example, having a rectangular shape, a pair of polishing sections 1*a*, 1*b*, for example, disposed on one side of the housing so as to face each other, and a pair of load/unload units, for example, disposed on the other side of the housing for receiving cassettes 2*a*, 2*b* which accommodate a plurality of semiconductor wafers. Two transfer robots 4*a*, 4*b* for transferring semiconductor wafers are disposed, for example, on a line connecting the polishing sections 1*a*, 1*b* to the load/unload units, to form a transfer line. Two inverters 5, 6 are disposed on both sides of the transfer line, and two sets of cleaning units 7*a*, 7*b* and 8*a*, 8*b* are disposed on both sides of the transfer line. In the present embodiment, inverter 5 is interposed between cleaning units 7*a* and 8*a*, and inverter 6 is interposed between cleaning units 7*b* and 8*b*.

Two polishing sections 1*a*, 1*b* may have basically the same specifications, and may be positioned symmetrically with respect to the transfer line. Each polishing section 1*a*, 1*b* has a polishing table 11 having a polishing pad (polishing cloth) 10 attached to an upper surface thereof, a top ring unit 20 for holding a workpiece W to be polished, such as a semiconductor wafer, by vacuum suction and pressing the semiconductor wafer W against polishing table 11 to polish the semiconductor wafer W, and a dressing unit 30 for dressing (or conditioning) the polishing pad on polishing table 11. Each polishing section 1*a*, 1*b* also has a pusher 12 disposed near the transfer line for receiving a semiconductor wafer W from top ring unit 20 and transferring the semiconductor wafer W to top ring unit 20.

Each transfer robot 4*a*, 4*b* may have an articulated arm which is bendable and stretchable within a horizontal plane, and upper and lower holding portions which are separately usable as a dry finger and a wet finger, respectively. Since two robots are used in the present embodiment, first robot 4*a* may basically be responsible for a region from inverters 5, 6 to cassettes 2*a*, 2*b*, and second robot 4*b* may basically be responsible for a region from inverters 5, 6 to polishing sections 1*a*, 1*b*.

Inverters 5, 6 serve to turn over a semiconductor wafer W, and may be disposed at positions accessible by hands of transfer robots 4*a*, 4*b*, respectively. In the present embodiment, two inverters 5, 6 are separately utilized as a device for handling a dry semiconductor wafer and a device for handling a wet semiconductor wafer, respectively.

Any type of cleaning unit can be applied to each cleaning unit 7*a*, 7*b*, 8*a* and 8*b*. For example, cleaning units 7*a*, 7*b* near polishing sections 1*a*, 1*b* may be of a type that wipes both surfaces of a semiconductor wafer with rollers having sponges, and cleaning units 8*a*, 8*b* near cassettes 2*a*; 2*b* may be of a type that holds a peripheral edge of a semiconductor wafer and rotates the semiconductor wafer within a horizontal plane while supplying a cleaning liquid to the semiconductor wafer. Cleaning units 8*a*, 8*b* may serve as a drier for centrifugally drying a semiconductor wafer. Cleaning units 7*a*, 7*b* can perform a primary cleaning process of a semiconductor wafer, and cleaning units 8*a*, 8*b* can perform a secondary cleaning process of the semiconductor wafer after the primary cleaning process.

Figure 4:
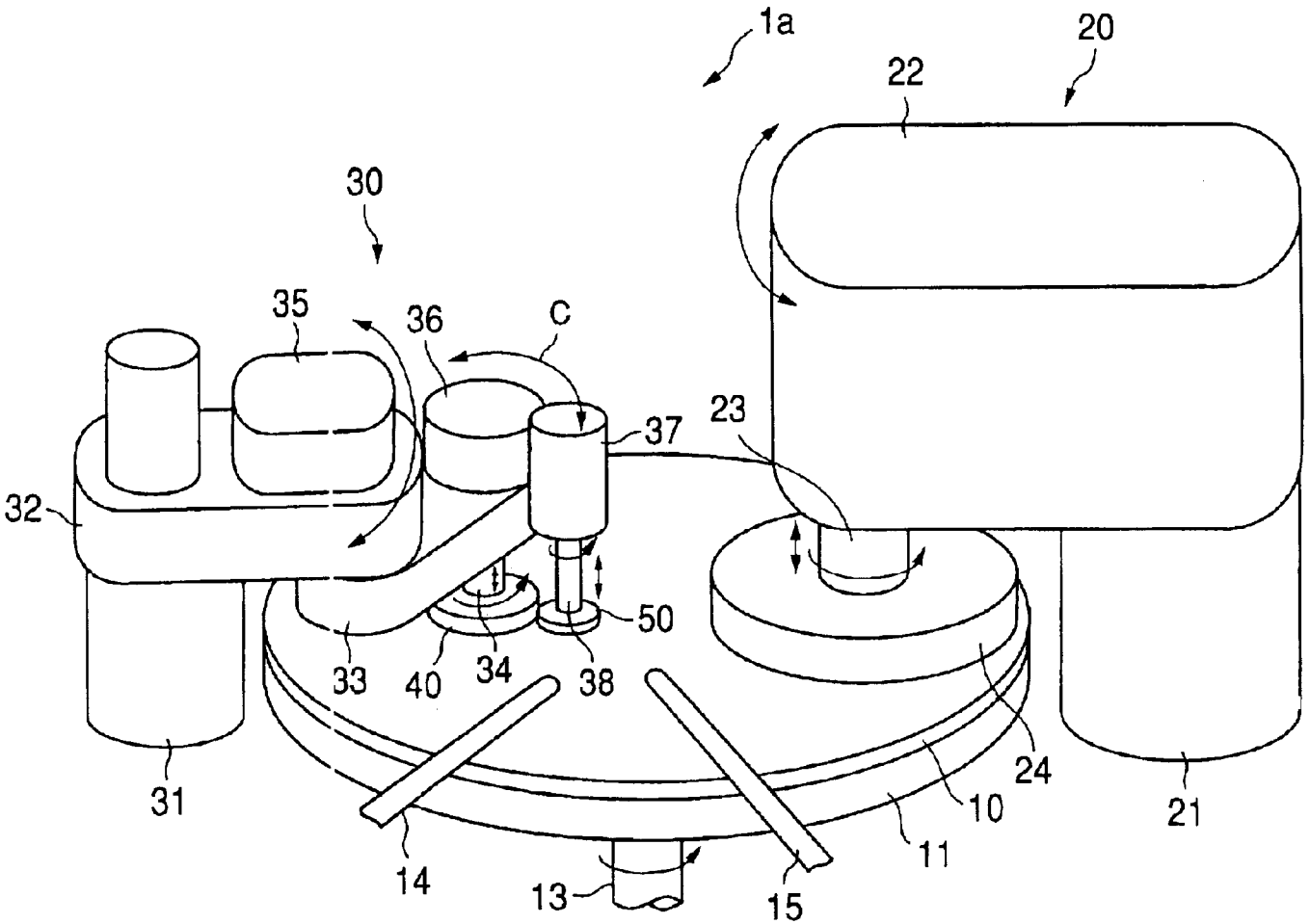
FIG. 4 is a perspective view schematically showing a polishing section of the polishing apparatus shown in FIG. 3.

The polishing sections in the polishing apparatus will be described below. FIG. 4 is a perspective view schematically showing the polishing section 1*a* in the polishing apparatus shown in FIG. 3. Although only the polishing section 1*a* will be described below, the following description can be applied to the polishing section 1*b*.

As shown in FIG. 4, polishing section 1*a* has polishing table 11 having polishing pad 10 attached to an upper surface thereof, top ring unit 20 for holding a workpiece W to be polished, such as a semiconductor wafer, by vacuum suction and pressing the semiconductor wafer W against polishing table 11 to polish the semiconductor wafer W, and dressing unit 30 for dressing (or conditioning) polishing pad 10 on polishing table 11. Polishing pad 10 on polishing table 11 has an upper surface serving as a polishing surface which is brought into sliding contact with a semiconductor wafer to be polished. Polishing table 11 may be coupled via a table shaft 13 to a motor (not shown) provided below table shaft 13. Thus, polishing table 11 may be rotatable about table shaft 13.

As shown in FIG. 4, a polishing liquid/water supply nozzle 14 and an atomizer 15 may be disposed above polishing table 11. Polishing liquid/water supply nozzle 14 may supply a polishing liquid used for a polishing process and a dressing liquid (e.g., water) used for a dressing process onto polishing pad 10. Atomizer 15 has a plurality of ejection nozzles (not shown) connected to a nitrogen gas supply source and a liquid supply source. Atomizer 15 may eject a liquid composed of a mixture of a liquid or nitrogen gas with pure water or a chemical liquid onto polishing table 11. Nitrogen gas from the nitrogen gas supply source and pure water or a chemical liquid from the liquid supply source may be passed through a regulator or air operated valve (not shown) to regulate pressure thereof to a predetermined value, and supplied to the ejection nozzles in atomizer 15 in a mixed state. Other inert gases may be used instead of nitrogen gas.

The mixture of nitrogen gas with pure water or the chemical liquid may be supplied in a state of (1) liquid fine particles, (2) solid fine particles as a result of solidification of the liquid, or (3) gas as a result of vaporization of the liquid. These states (1), (2) and (3) are referred to as atomization. In these states, the mixture may be ejected from the ejection nozzles of atomizer 15 toward polishing pad 10. For example, pressure or temperature of the nitrogen gas and/or the pure water or the chemical liquid, or the shape of the nozzles determines which state of the mixed liquid is to be ejected, i.e., liquid fine particles, solid fine particles, or gas. Therefore, the state of the liquid to be ejected can be varied, for example, by properly adjusting pressure or temperature of the nitrogen gas and/or the pure water or the chemical liquid with use of a regulator or the like, or by properly adjusting the shape of the nozzles.

Top ring unit 20 serves to hold a semiconductor wafer to be polished by vacuum suction and to press the semiconductor wafer against polishing table 11 to polish the semiconductor wafer. As shown in FIG. 4, top ring unit 20 may have a rotatable support shaft 21, a top ring head 22 mounted to an upper end of support shaft 21, top ring shaft 23 extending along its axis from a free end of top ring head 22, and a disk-shaped top ring 24 connected to a lower end of top ring shaft 23. When support shaft 21 is rotated, top ring 24 may be horizontally moved by a swinging motion of top ring head 22. Thus, top ring 24 is movable between a position above pusher 12 and a polishing position above polishing pad 10, as shown by arrows A in FIG. 3.

Top ring 24 may be connected via top ring shaft 23 to a motor and a lifting/lowering cylinder (not shown) provided in top ring head 22. Thus, top ring 24 may be vertically movable by the lifting/lowering cylinder and may be rotatable about top ring shaft 23 by the motor. A semiconductor wafer to be polished may be attracted to and held on a lower surface of top ring 24 by vacuum suction or the like. With the above mechanisms, top ring 24 can press a semiconductor wafer held on the lower surface thereof against polishing pad 10 at a desired pressure while being rotated.

Dressing unit 30 serves to regenerate a surface of polishing pad 10 which has been deteriorated by a polishing process. In the present embodiment, dressing unit 30 may have a diamond dresser (a first dresser) 40 for dressing a surface of polishing pad 10 by thinly shaving the surface of polishing pad 10, and, a brush dresser (a second dresser) 50 for scraping polishing particles or polishing wastes which have clogged concavities formed in the surface of polishing pad 10.

Dressing unit 30 may be disposed at an opposite side of top ring unit 20 with respect to a center of polishing table 11. As shown in FIG. 4, dressing unit 30 may have a rotatable support shaft 31, a dresser head 32 mounted to an upper end of support shaft 31, and a swing arm 33 provided at an end of dresser head 32. Dresser head 32 may have a swing motor 35 provided on an upper portion thereof. Swing arm 33 may be coupled to swing motor 35 provided on dresser head 32. Thus, when support shaft 31 is rotated, dresser head 32 may be swung in a direction substantially parallel to an upper surface of polishing pad 10, as shown by arrows B in FIG. 3. Further, when the swing motor 35 is driven, the swing arm 33 is horizontally swung as shown by an arrow C in FIG. 4.

As shown in FIG. 4, dressing unit 30 may have a dresser shaft 34 extending along its axis from a free end of swing arm 33. Disk-shaped diamond dresser 40 may be connected to a lower end of dresser shaft 34. Dresser shaft 34 may be connected to a driving mechanism 36 (air cylinder and motor) provided on an upper portion of swing arm 33. With driving mechanism 36, diamond dresser 40 connected to dresser shaft 34 may be movable along and rotatable about the axis of dresser shaft 34.

Figure 5:
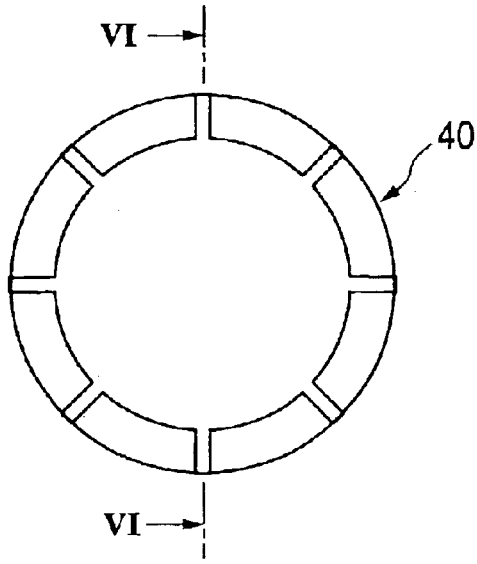
FIG. 5 is a bottom view showing a diamond dresser of the polishing apparatus according to the first embodiment of the present invention.
Figure 6:
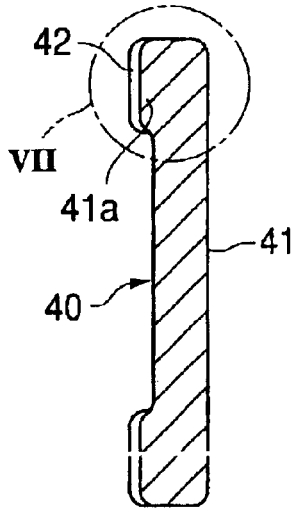
FIG. 6 is a cross-sectional view taken along a line VI—VI of FIG. 5.
Figure 7:
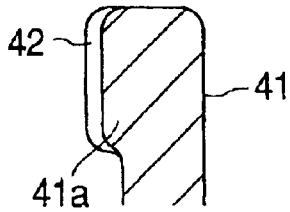
FIG. 7 is an enlarged view of a portion VII in FIG. 6.

Diamond dresser 40 may have a plurality of fan-shaped elements (dressing elements) having particulates such as diamond particles electrodeposited on peripheral portions of a lower surface thereof. FIGS. 5 through 7 show a detailed structure of diamond dresser 40 in the present embodiment. FIG. 5 is a bottom view, FIG. 6 is a cross-sectional view taken along a line VI—VI of FIG. 5, and FIG. 7 is an enlarged view of a portion VII in FIG. 6. As shown in FIGS. 5 through 7, diamond dresser 40 is in a disk form and has a dresser body 41. Dresser body 41 may have band-shaped protrusions 41*a* provided on a peripheral portion of a lower surface thereof and having predetermined circumferential widths for electrodepositing fine particles of diamond thereon. Diamond electrodeposition rings 42 formed by electrodepositing fine particles of diamond are provided on the surfaces of protrusions 41*a*. Each diamond electrodeposition ring 42 may have a structure such that fine particles of diamond are deposited on the surfaces of protrusions 41*a*, and the portions on which diamond is deposited may be plated with nickel to bond the fine particles of diamond to the surfaces of protrusions 41*a* by nickel plating layers.

When diamond dresser 40 performs dressing, while polishing table 11 and diamond dresser 40 are rotated, a dressing liquid such as pure water and, if necessary, a polishing liquid are supplied from polishing liquid/water supply nozzle 14 to the central portion of rotating polishing pad 10. In such a state, the lower surfaces of diamond electrodeposition rings 42 may be brought into contact with the surface of polishing pad 10 to thinly shave the surface of polishing pad 10. Thus, polishing pad 10 may be dressed by diamond dresser 40.

As shown in FIG. 4, a driving mechanism (air cylinder and motor) 37 may be provided near a free end of swing arm 33. A dresser shaft 38 may extend along its axis from the driving mechanism 37. Disk-shaped brush dresser 50 may be connected to the lower end of dresser shaft 38. Thus, brush dresser 50 connected to dresser shaft 38 may be movable along and rotatable about the axis of dresser shaft 38.

Figure 8:
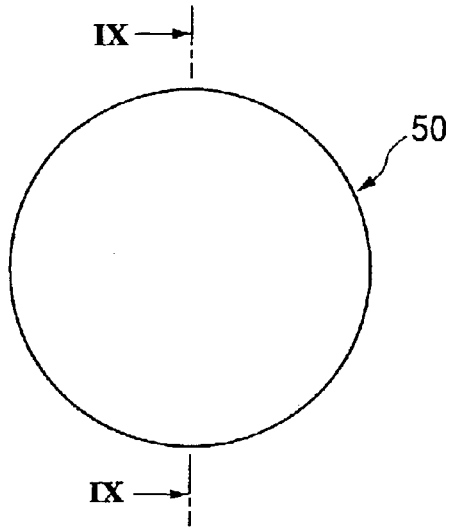
FIG. 8 is a bottom view showing a brush dresser of the polishing apparatus according to the first embodiment of the present invention.
Figure 9:
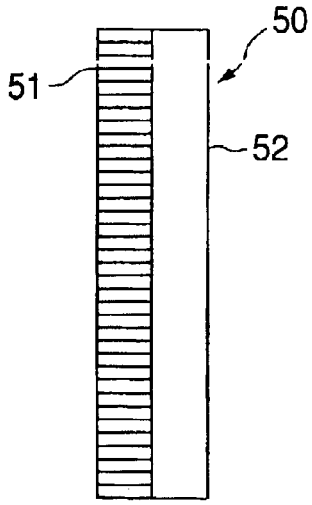
FIG. 9 is a cross-sectional view taken along a line IX—IX of FIG. 8.

Brush dresser 50 may have a brush on an entire area of a lower surface thereof. FIGS. 8 and 9 show a detailed structure of brush dresser 50 in the present embodiment. FIG. 8 is a bottom view, and FIG. 9 is a cross-sectional view taken along a line IX—IX of FIG. 8. As shown in FIGS. 8 and 9, brush dresser 50 may be in a disk form, and may have a dresser body 52 and a brush 51 of nylon on an entire area of a lower surface of the dresser body 52.

When brush dresser 50 performs dressing, while polishing table 11 and brush dresser 50 are rotated, a dressing liquid such as pure water may be supplied from polishing liquid/water supply nozzle 14 to the central portion of rotating polishing pad 10. In such a state, brush 51 may be brought into contact with the surface of polishing pad 10 to remove aggregations of slurry (polishing liquid) and polishing wastes from polishing pad 10. As described above, when a polishing process and a dressing process are repeatedly performed, concavities formed in polishing pad 10, such as grooves or fine holes, for enhancing capability of holding a polishing liquid on a surface of polishing pad 10 are clogged with foreign matter such as polishing wastes and polishing liquid used in the polishing process, or dressing wastes produced by the dressing process. According to the present embodiment, the foreign matter may be scraped from the concavities in polishing pad 10 with brush 51 of brush dresser 50. Therefore, polishing pad 10 can be regenerated to have a high polishing performance, and high-quality polishing can be achieved for subsequent semiconductor wafer.

As shown in FIG. 3, the polishing section 1*a* may have a dresser cleaning chamber 16 disposed at a standby position of dressing unit 30 outside polishing table 11 for cleaning a lower surface of brush 51 of brush dresser 50 and/or a lower surface of diamond dresser 40. With dresser cleaning chamber 16, it is possible to prevent solidification of a polishing liquid or the like which is attached to lower surfaces of brush 51 of brush dresser 50 and diamond dresser 40 in a dressing process.

Figure 10:
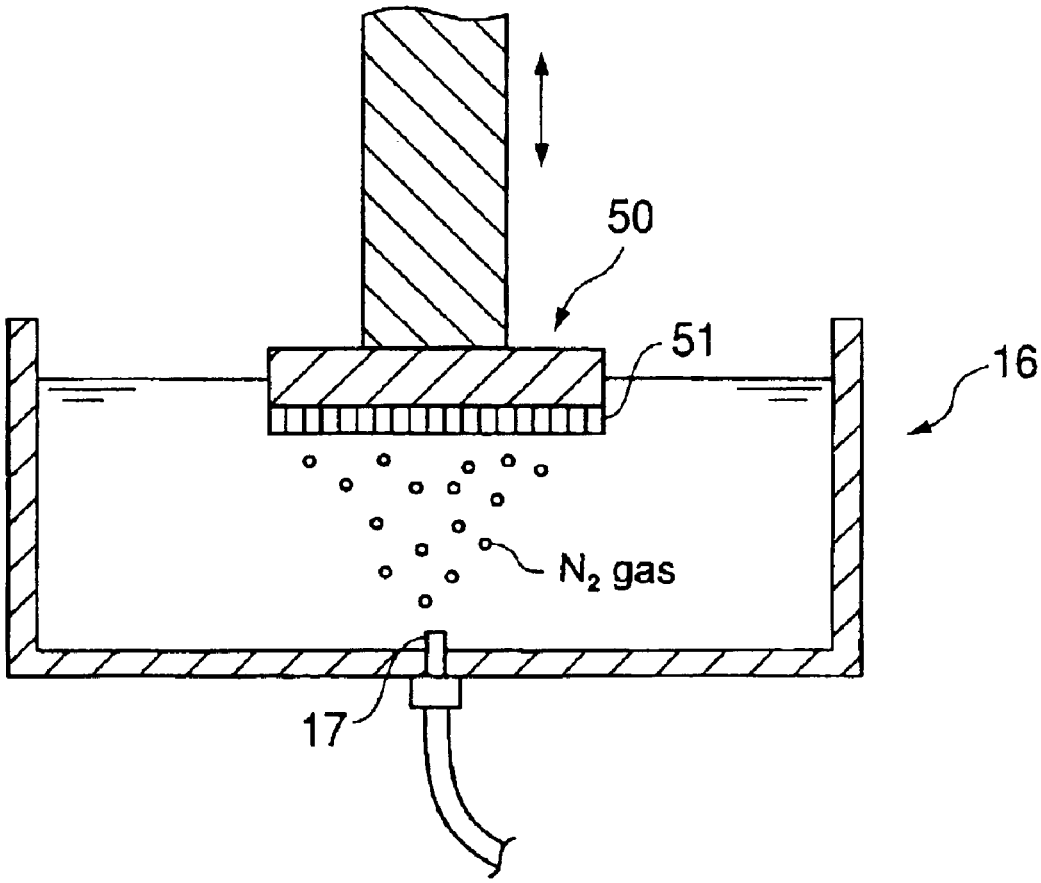
FIG. 10 is a schematic cross-sectional view showing an example of a dresser cleaning chamber in the polishing apparatus shown in FIG. 3.

FIG. 10 is a schematic cross-sectional view showing an example of dresser cleaning chamber 16 for cleaning brush 51 of brush dresser 50. Dresser cleaning chamber 16 shown in FIG. 10 may hold pure water therein and may have a nozzle 17 disposed at a bottom thereof for ejecting inert gas such as nitrogen gas. Brush dresser 50 may be immersed into the pure water of dresser cleaning chamber 16, and a polishing liquid attached to brush 51 of brush dresser 50 may be removed by the inert gas ejected from nozzle 17. In this case, instead of ejection of inert gas, brush 51 of brush dresser 50 may be cleaned by ultrasonic vibration. If diamond dresser 40 is cleaned by ultrasonic vibration, then electrodeposited diamond particles may be removed from the lower surface of the diamond dresser 40. Therefore, when brush 51 of brush dresser 50 is cleaned by ultrasonic vibration, polishing section 1*a* should preferably have a first dresser cleaning chamber for ultrasonically cleaning brush dresser 50 and a second dresser cleaning chamber disposed near the first dresser cleaning chamber for cleaning diamond dresser 40, separately.

Figure 11:
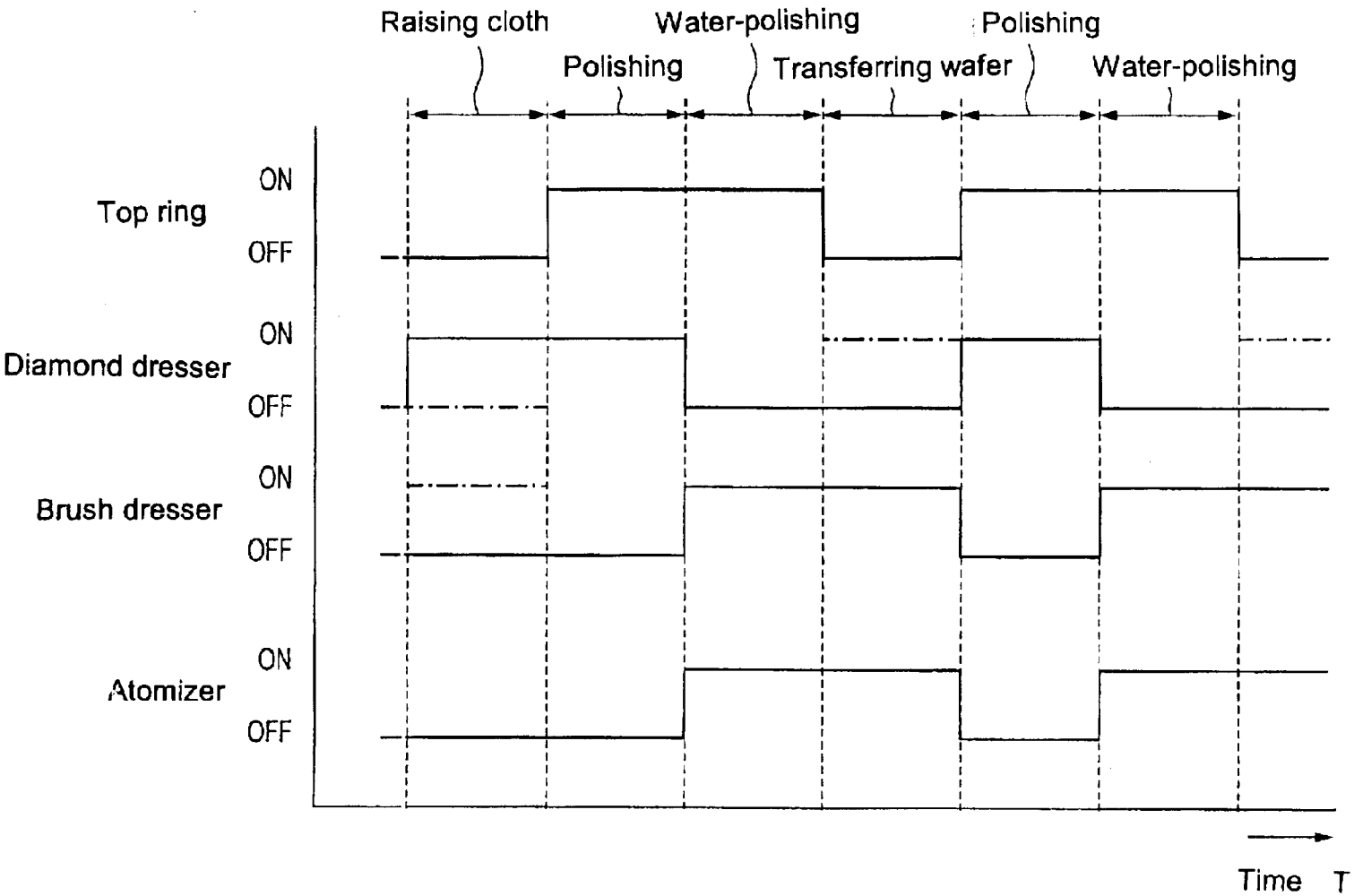
FIG. 11 is a timing chart showing a series of a polishing process and a dressing process with the polishing apparatus shown in FIG. 3.

Next, operation of polishing semiconductor wafers and dressing polishing pad with the polishing apparatus thus constructed will be described below. FIG. 11 is a timing chart showing a series of a polishing process and a dressing process in the present embodiment.

First, initial surface conditioning of polishing pad 10 may be performed prior to a polishing process. The surface of polishing pad 10 may be thinly shaved by diamond dresser 40 of dressing unit 30 to thereby perform the initial surface conditioning of polishing pad 10 before polishing. In this case, swing motor 35 mounted on dresser head 32 of dressing unit 30 may be driven to move, in a direction substantially parallel to the upper surface of polishing pad 10, swing arm 33 and to swing diamond dresser 40 of dressing unit 30 on polishing pad 10. Driving mechanism 36 may be driven to rotate and move diamond dresser 40 toward polishing pad 10 so that diamond dresser 40 is brought into abutment against polishing pad 10 under a predetermined pressure. At that time, at the moment or before diamond dresser 40 is brought into contact with polishing pad 10, water may be supplied from polishing liquid/water supply nozzle 14 onto the upper surface of polishing pad 10. Thus, the polishing surface is conditioned on the entire area thereof. Simultaneously, brush dresser 50 may be pressed against polishing pad 10 to remove polishing wastes from the surface of polishing pad 10.

After completion of the initial surface conditioning of polishing pad 10, top ring 24 of top ring unit 20 may receive the semiconductor wafer from pusher (device for delivering a wafer) 12, and may be moved to the polishing position on polishing pad 10 by rotation of support shaft 21. While top ring 24 and polishing table 11 are being rotated independently of each other, the semiconductor wafer held by top ring 24 and polishing table 11 may be moved relative to each other. The semiconductor wafer held on the lower surface of top ring 24 may then be pressed against polishing pad 10 on polishing table 11. In this state, a polishing liquid may be supplied from polishing liquid/water supply nozzle 14 onto an upper surface of polishing pad 10. For example, the polishing liquid may comprise a suspension of fine polishing particles in an alkali solution. Thus, the semiconductor wafer may be polished by the combined effect of a chemical polishing effect attained by the alkali and a mechanical polishing effect attained by the polishing particles.

During this polishing process, diamond dresser 40 of dressing unit 30 may perform dressing (in-situ dressing) to thinly shave the surface of polishing pad 10 for conditioning the polishing surface. During the in-situ dressing process, swing arm 33 and diamond dresser 40 may be swung by swing motor 35. Time of dressing by diamond dresser 40 during a polishing process of the semiconductor wafer may be selected properly. Further, speed and distance of swinging motion of the dresser can properly be selected. The dresser may be moved on divided regions of polishing pad 10 at different speeds corresponding to the respective divided regions.

After completion of the polishing process, a water-polishing process may be performed. In the water-polishing process, pure water is used as a polishing liquid, and a polishing pressure and/or a polishing rate is set to be lower than that in a normal polishing process. With such a water-polishing process, fine scratches produced on a surface of the semiconductor wafer by a polishing process can be eliminated, and simultaneously particles such as polishing particles or polishing wastes present on the surface of the semiconductor wafer can be removed from the surface of the semiconductor. During the water-polishing process, brush dresser 50 may perform the dressing. In this case, swing motor 35 mounted on dresser head 32 of dressing unit 30 may be driven to move, in a direction substantially parallel to the upper surface of polishing pad 10, swing arm 33 and to swing brush dresser 50 of dressing unit 30 on polishing pad 10. Driving mechanism 37 may be driven to rotate and move brush dresser 50 toward polishing pad 10 so that brush dresser 50 is brought into abutment against polishing pad 10 under a predetermined pressure. Thus, polishing pad 10 may be dressed by brush dresser 50.

As described above, with dressing by brush dresser 50, foreign matter clogging concavities formed in polishing pad 10 may be scraped by brush 51 to remove the foreign matter. Therefore, the polishing surface can be regenerated to have a high polishing performance, and high-quality polishing can be achieved for subsequent semiconductor wafers. Further, it is possible to recover a polishing rate at a central portion of the surface of the semiconductor wafer, which has been lowered by repetition of the polishing process and the dressing process, to a level equal to that of a new polishing pad. Time of dressing by dressing unit 30 during a water-polishing process may be selected properly.

During the dressing process, brush 51 may be moved from the central portion of the polishing surface to a peripheral portion of the polishing surface by a swinging motion thereof. Alternatively, brush 51 may be moved from a peripheral portion of the polishing surface to the central portion of the polishing surface and then moved to the peripheral portion thereof. This movement allows foreign matter scraped from concavities in polishing pad 10 to be effectively discharged to an exterior of polishing pad 10.

During dressing by brush dresser 50, nitrogen gas and pure water or a chemical liquid may be supplied to atomizer 15 under a predetermined pressure and temperature, and a liquid composed of a mixture of the nitrogen gas with the pure water or the chemical liquid may be ejected toward polishing pad 10 from the ejection nozzles of atomizer 15. Thus, the mixed liquid may be ejected onto polishing pad 10 in an atomized state, and a polishing liquid and polishing wastes on polishing pad 10 are scattered toward an outside of polishing table 11. Therefore, a polishing liquid and polishing wastes on polishing pad 10, which cause scratches to be produced on the semiconductor wafer, can effectively be removed from the surface of polishing pad 10. In this case, gas in the mixed liquid may serve not only to remove a polishing liquid and polishing wastes from polishing pad 10, but also to scrape a polishing liquid and polishing wastes clogging concavities formed in polishing pad 10. Therefore, the atomization during dressing by brush dresser 50 may be effective in addition to the aforementioned effect due to brush dresser 50. The foreign matter scraped by brush dresser 50 and the polishing liquid or polishing wastes scraped by atomizer 15 may be washed away by the pure water or the chemical liquid ejected from atomizer 15. The atomization by atomizer 15 can be performed in any time during dressing by brush dresser 50 or in any time before or after dressing by brush dresser 50. Atomizer 15 may eject only a liquid such as pure water or a chemical liquid. In this case, similar effects can be expected.

After completion of the water-polishing process, top ring 24 may be moved above pusher (device for delivering a wafer) 12, and the semiconductor wafer held by top ring 24 may be transferred to pusher 12. At this time, dressing by brush dresser 50 and atomization by atomizer 15 may be continuously performed as shown in the timing chart of FIG. 11.

As shown by a dashed line in FIG. 11, dressing by diamond dresser 40 may not be performed when initially raising cloth. Alternatively, as shown by a dashed line in FIG. 11, brush dresser 50 may perform dressing when initially raising cloth. In the present embodiment, diamond dresser 40 performs dressing during a polishing process of a semiconductor wafer, i.e., in-site dressing. However, diamond dresser 40 may perform dressing when a semiconductor wafer is transferred, i.e., ex-situ dressing.

As described above, the motor of driving mechanism 37 rotates brush dresser 50 during dressing. However, when a small-diameter or compact brush dresser 50 is used in a polishing apparatus and swung on polishing pad 10, brush dresser 50 does not need to be rotated during dressing. Therefore, it is not necessary to provide a rotation mechanism (the motor of driving mechanism 37). Only a rotatable mechanism which has a shaft and a bearing but no motor, for example, may be provided so as to rotate brush dresser 50 by friction of contact with polishing pad 10. Further, when brush dresser 50 is disposed in the vicinity of diamond dresser 40, a swinging mechanism for diamond dresser 40 (i.e., swing arm 33 and swing motor 35) can be utilized for brush dresser 50. In this case, brush dresser 50 requires only a moving mechanism for moving brush dresser 50, in a direction toward or a direction away from polishing pad 10, independently of diamond dresser 40 (i.e., the air cylinder of driving mechanism 37), and hence, a polishing apparatus can be made compact in size.

Figure 12:
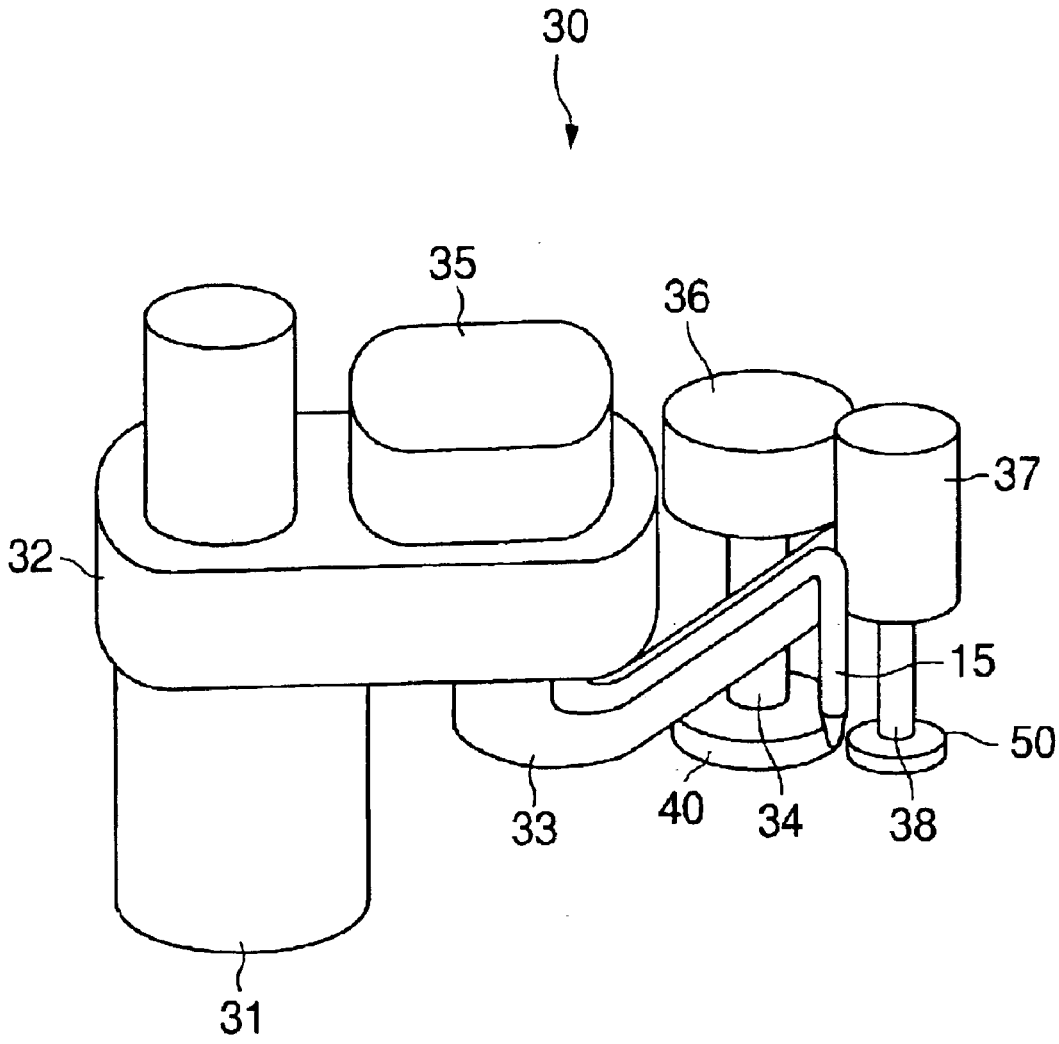
FIG. 12 is a perspective view schematically showing a modification of a dressing unit in the polishing apparatus shown in FIG. 3.

In the present embodiment, atomizer 15 may be provided separately from dressing unit 30. However, an atomizer 15 may be mounted to swing arm 33 of dressing unit 30, as shown in FIG. 12. With this arrangement, a polishing apparatus can be made more compact in size.

Figure 13:
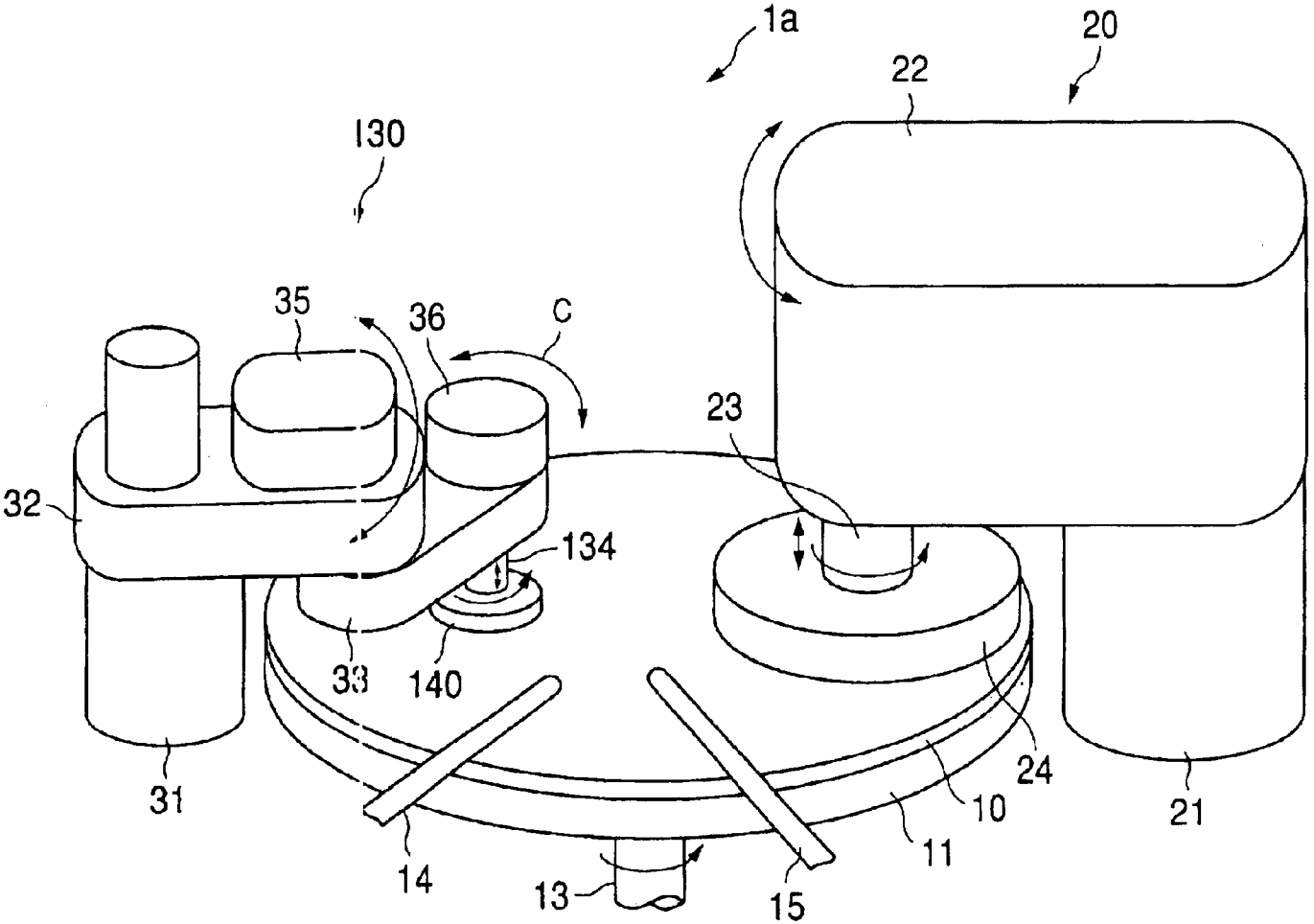
FIG. 13 is a perspective view schematically showing a polishing section of a polishing apparatus according to a second embodiment of the present invention.
Figure 14:
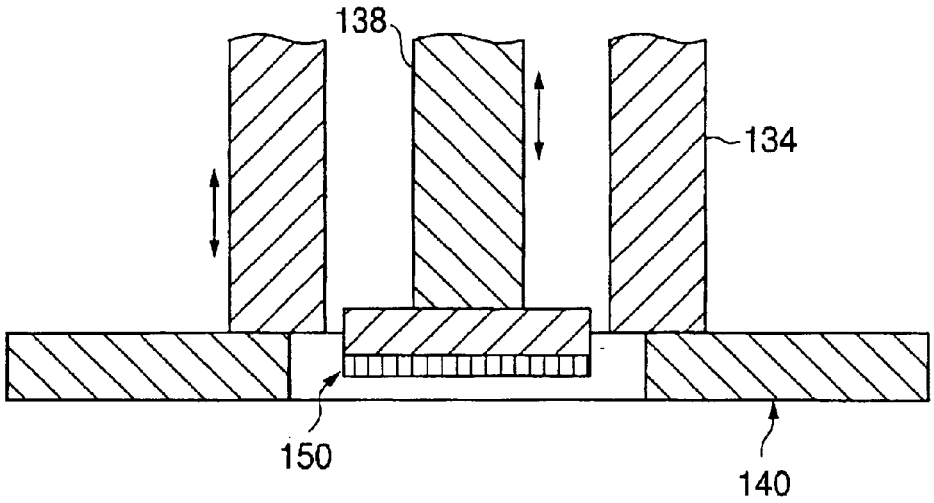
FIG. 14 is a vertical cross-sectional view showing a structure of a dresser in the polishing section shown in FIG. 13.

A polishing apparatus according to a second embodiment of the present invention will be described below with reference to FIGS. 13 and 14. FIG. 13 is a perspective view schematically showing a polishing section of a polishing apparatus according to the second embodiment of the present invention, and FIG. 14 is a vertical cross-sectional view showing a structure of a dresser in the polishing section shown in FIG. 13. In FIGS. 13 and 14, like or corresponding parts are denoted by the same reference numerals as those in the first embodiment, and will not be described below repetitively.

In the second embodiment, as shown in FIGS. 13 and 14, a dressing unit 130 may have a dresser shaft 134 extending from a free end of a swing arm 33, and an annular disk-shaped diamond dresser 140 connected to a lower end of the dresser shaft 134. As shown in FIG. 14, dresser shaft 134 may be in the form of a hollow cylinder and housing a dresser shaft 138 in a hollow portion thereof. A disk-shaped brush dresser 150 may be connected to a lower end of dresser shaft 138. Brush dresser 150 may be located inside of diamond dresser 140 in a radial direction thereof. Both of dresser shafts 134 and 138 may be coupled to a driving mechanism 36 (air cylinder and motor) provided on an upper portion of swing arm 33. With driving mechanism 36, diamond dresser 140 connected to dresser shaft 134 and brush dresser 150 connected to dresser shaft 138 may be movable, in a direction toward or a direction away from polishing pad 10, and rotatable independently of each other.

With dressing unit 130 thus constructed, when diamond dresser 140 performs dressing, driving mechanism 36 may be driven to rotate and move diamond dresser 140 toward polishing pad 10 so that diamond dresser 140 is brought into abutment against polishing pad 10 under a predetermined pressure. Thus, the polishing surface on polishing pad 10 is conditioned over the entire area thereof. At this time, brush dresser 150 may not be rotated or moved toward polishing pad 10 by the driving mechanism 36.

On the other hand, when brush dresser 150 performs dressing, driving mechanism 36 may be driven to rotate and move brush dresser 150 toward polishing pad 10 so that brush dresser 150 is brought into abutment against polishing pad 10 under a predetermined pressure. In this manner, foreign matter clogging concavities in polishing pad 10 is scraped from the concavities. At this time, the diamond dresser 140 may not be rotated or moved toward polishing pad 10 by driving mechanism 36.

Figure 15:
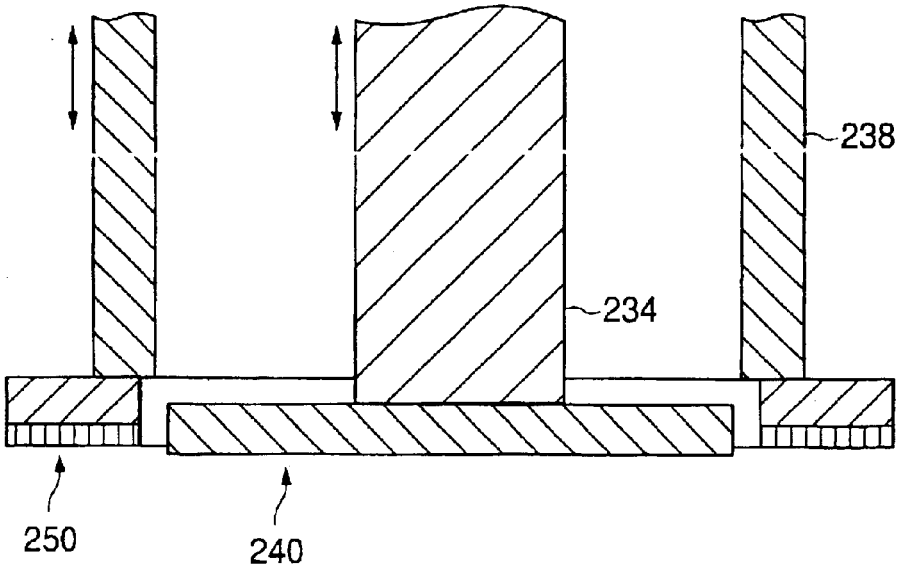
FIG. 15 is a vertical cross-sectional view showing a modification of the dresser shown in FIG. 14.

In the present embodiment, brush dresser 150 may be located inside of diamond dresser 140 in a radial direction thereof. However, as shown in FIG. 15, a diamond dresser 240 may be located inside of a brush dresser 250 in a radial direction thereof. In FIG. 15, an annular disk-shaped brush dresser 250 may be connected to a lower end of a dresser shaft 238 which may be in the form of a hollow cylinder. A dresser shaft 234 may be housed in a hollow portion of dresser shaft 238. A disk-shaped diamond dresser 240 may be connected to a lower end of dresser shaft 234. Diamond dresser 240 may be located inside of brush dresser 250 in a radial direction thereof. Both of diamond dresser 240 and brush dresser 250 are movable, in a direction toward or a direction away from polishing pad 10, and rotatable independently of each other, as in the case of the second embodiment.

Figure 16:
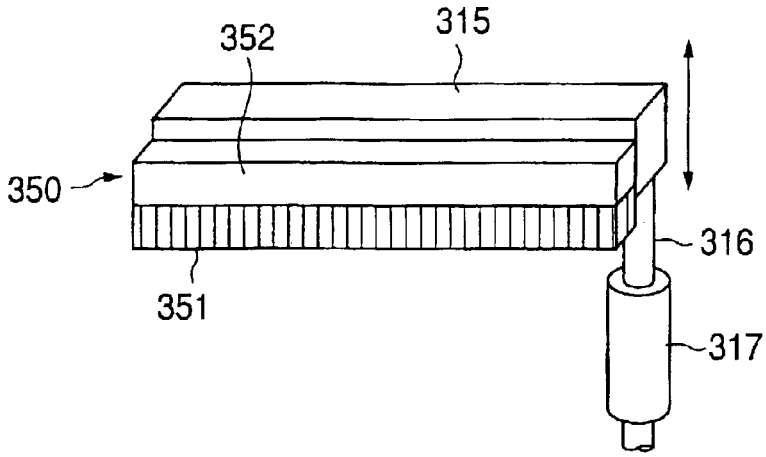
FIG. 16 is a perspective view schematically showing an atomizer of a polishing apparatus according to a third embodiment of the present invention.
Figure 17:
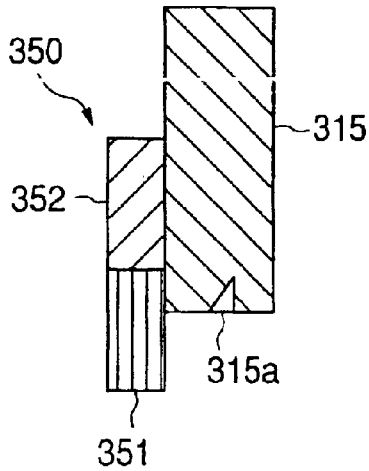
FIG. 17 is a vertical cross-sectional view of FIG. 16.

A polishing apparatus according to a third embodiment of the present invention will be described below with reference to FIGS. 16 and 17. FIG. 16 is a perspective view schematically showing an atomizer of a polishing apparatus according to the third embodiment, and FIG. 17 is a vertical cross-sectional view of FIG. 16. In the present embodiment, a brush dresser 350 may be mounted on an atomizer 315. A diamond dresser having the same structure as a conventional diamond dresser may be used in the present embodiment, and will not be described repetitively.

As shown in FIGS. 16 and 17, brush dresser 350 may be mounted on a side surface of atomizer 315. Brush dresser 350 may have a dresser body 352 and a brush 351 extending away from a lower surface of dresser body 352. Atomizer 315 may have a plurality of ejection nozzles 315*a* connected to a nitrogen gas supply source and a liquid supply source through a pipe 316. A moving mechanism 317 for moving, in a direction toward or a direction away from polishing pad 10, atomizer 315 may be provided on pipe 316.

When brush dresser 350 performs dressing, moving mechanism 317 may be driven to lower atomizer 315 and brush dresser 350 so that brush 351 of brush dresser 350 is brought into abutment against polishing pad 10 under a predetermined pressure. In this manner, foreign matter clogging concavities in polishing pad 10 is scraped from the concavities. In this case, a cleaning liquid such as pure water may be ejected from ejection nozzles 315*a* to wash away a polishing liquid attached to brush 351 of brush dresser 350 after the dressing process. Thus, atomizer 315 can also serve as a dresser cleaning device.

Figure 18:
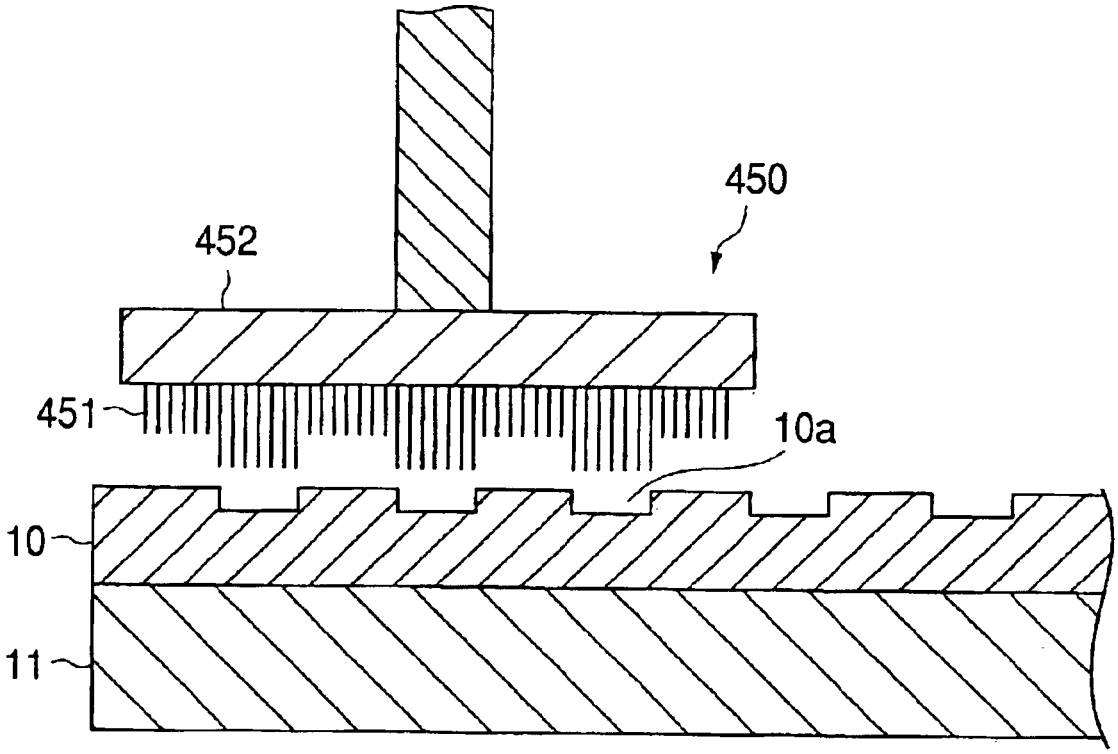
FIG. 18 is a vertical cross-sectional view showing a modification of the brush dresser shown in FIG. 9.

The shape of the brush provided on the brush dresser in the above embodiments is not limited to shape shown in FIGS. 8 and 9 or FIGS. 16 and 17. FIG. 18 is a vertical cross-sectional view showing a modification of the brush dresser shown in FIG. 9. A brush dresser 450 shown in FIG. 18 may have a dresser body 452 and a brush 451 mounted on the entire area of a lower surface of dresser body 452 and having a shape corresponding to a shape concavities 10*a* formed in polishing pad 10 on polishing table 11. Specifically, in order that brush 451 can easily get into concavities (grooves) 10*a* formed in polishing pad 10, tips of brush 451 may be formed into concavo-convex shape by setting the length of brush 451 to correspond to a shape of concavities 10*a*. With brush 451 having a shape corresponding to a shape of concavities 10*a* formed in polishing pad 10, foreign matter can more effectively be scraped from concavities 10*a* in polishing pad 10.

Although certain preferred embodiments of the present invention have been shown and described in detail, it should be understood that various changes and modifications may be made therein without departing from the scope of the appended claims.

What is claimed is:

1. A polishing apparatus comprising:

a polishing table having a polishing surface thereon, said polishing surface having concavities formed therein;

a top ring for holding a workpiece and pressing the workpiece against said polishing surface to polish the workpiece;

a first dresser for conditioning said polishing surface, said first dresser being operable to press a first dressing element against said polishing surface to shave off a portion of said polishing surface;

a second dresser for scraping foreign matter clogging said concavities, said second dresser being operable to press a second dressing element against said polishing surface when a polishing liquid is not supplied to said polishing table; and an atomizer operable to eject a liquid composed of a mixture of an inert gas with pure water or a chemical liquid onto said polishing surface to clean said polishing surface, wherein said second dresser is mounted on said atomizer, and wherein said atomizer is operable to clean said second dresser.

2. The polishing apparatus according to claim 1, further comprising a dresser cleaning chamber operable to clean at least one of said first dresser and said second dresser.

3. The polishing apparatus according to claim 1, wherein said second dresser comprises a brush dresser.

4. The polishing apparatus according to claim 3, wherein said brush dresser has a brush having a shape corresponding to a shape of said concavities.

5. A method for dressing a polishing surface of a polishing table, said method comprising:

conditioning a polishing surface by pressing a first dresser against said polishing surface to shave off a portion of said polishing surface;

scraping foreign matter clogging concavities formed in said polishing surface by pressing a second dresser, mounted on an atomizer, against said polishing surface when a polishing liquid is not supplied to said polishing surface;

ejecting a liquid, composed of a mixture of an inert gas with pure water or a chemical liquid, onto said polishing surface from said atomizer to clean said polishing surface; and cleaning said second dresser by utilizing said atomizer.

6. The method according to claim 5, further comprising cleaning at least one of said first dresser and said second dresser in a dresser cleaning chamber.

7. The method according to claim 5, wherein said second dresser comprises a brush dresser.

8. The method according to claim 7, wherein said brush dresser has a brush having a shape corresponding to a shape of said concavities.

* * * * *